US010273690B2

(12) United States Patent
Safari

(10) Patent No.: US 10,273,690 B2
(45) Date of Patent: Apr. 30, 2019

(54) TRUSS COMPOSITE CEILING WITH LITTLE AMOUNT OF STEEL

(71) Applicant: Ruhollah Safari, Ghazvin (IR)

(72) Inventor: Ruhollah Safari, Ghazvin (IR)

( * ) Notice: Subject to any disclaimer, the term of this patent is extended or adjusted under 35 U.S.C. 154(b) by 0 days.

(21) Appl. No.: 15/854,090

(22) Filed: Dec. 26, 2017

(65) Prior Publication Data

US 2018/0179755 A1 Jun. 28, 2018

(51) Int. Cl.

| | |
|---|---|
| ***E04C 3/09*** | (2006.01) |
| ***E04B 7/02*** | (2006.01) |
| *E04C 3/04* | (2006.01) |
| *E04B 5/29* | (2006.01) |

(52) U.S. Cl.

CPC ..... *E04C 3/09* (2013.01); *E04B 7/022* (2013.01); *E04B 5/29* (2013.01); *E04B 2103/02* (2013.01); *E04B 2103/06* (2013.01); *E04C 2003/0413* (2013.01); *E04C 2003/0465* (2013.01); *E04C 2003/0491* (2013.01)

(58) Field of Classification Search

CPC .... E04C 3/09; E04C 2003/0491; E04B 7/022; E04B 2103/06; E04B 2103/02

See application file for complete search history.

(56) References Cited

U.S. PATENT DOCUMENTS

| | | | | |
|---|---|---|---|---|
| 8,720,154 | B1 * | 5/2014 | Horne | E04B 1/24 52/236.3 |
| 9,021,759 | B2 * | 5/2015 | Lehane, Jr. | E04B 9/067 52/506.07 |
| 9,803,365 | B2 * | 10/2017 | Peltier | E04C 3/09 |
| 2009/0249743 | A1 * | 10/2009 | Bodnar | E04C 3/09 52/846 |
| 2012/0247055 | A1 * | 10/2012 | Lawley | E04B 1/483 52/655.1 |
| 2017/0291682 | A1 * | 10/2017 | Sullivan | B64C 3/187 |

FOREIGN PATENT DOCUMENTS

| | | | | |
|---|---|---|---|---|
| CA | 2283084 | A1 * | 3/2001 | E04C 3/09 |
| CA | 2668945 | A1 * | 11/2010 | E04C 3/09 |
| EP | 1712697 | A2 * | 10/2006 | B21D 47/04 |
| GB | 2025798 | A * | 1/1980 | B23P 13/04 |
| WO | WO-2010104396 | A1 * | 9/2010 | E04C 3/09 |

* cited by examiner

*Primary Examiner* — Jeanette E Chapman
(74) *Attorney, Agent, or Firm* — Azadeh Saidi

(57) ABSTRACT

A new design for joists using cold rolling steel sheets and integrated parts is provided, that creates a sturdy yet easy to construct structure.

12 Claims, 5 Drawing Sheets

TRUSS COMPOSITE CEILING WITH LITTLE AMOUNT OF STEEL

BACKGROUND OF THE INVENTION

In the implementation of most roofs and structures, it is necessary to use reinforcement and molding in order to cast concrete and then open the molds afterwards; this technique take a lot of time. These the mold members do not have a structural role and are only used as molds that, in addition to being time consuming, will impose an extra cost to the project.

In composite roofs, the entire roof load is tolerated by steel beams, which makes it possible to use heavier steel beams, which will dramatically increase the cost.

In the conventional composite ceilings it is necessary to use a pin on the ceiling to create a connection and integrity between the roof beams and concrete slabs, which, in addition to its time, will increase the cost; however, in the designed ceiling, for the integrity of the concrete and the roof joists, there is no need for a pin.

Lightening the ceiling and structure, which results in less material being consumed, ultimately reduces environmental pollution.

SUMMARY OF THE INVENTION

Figure 1:
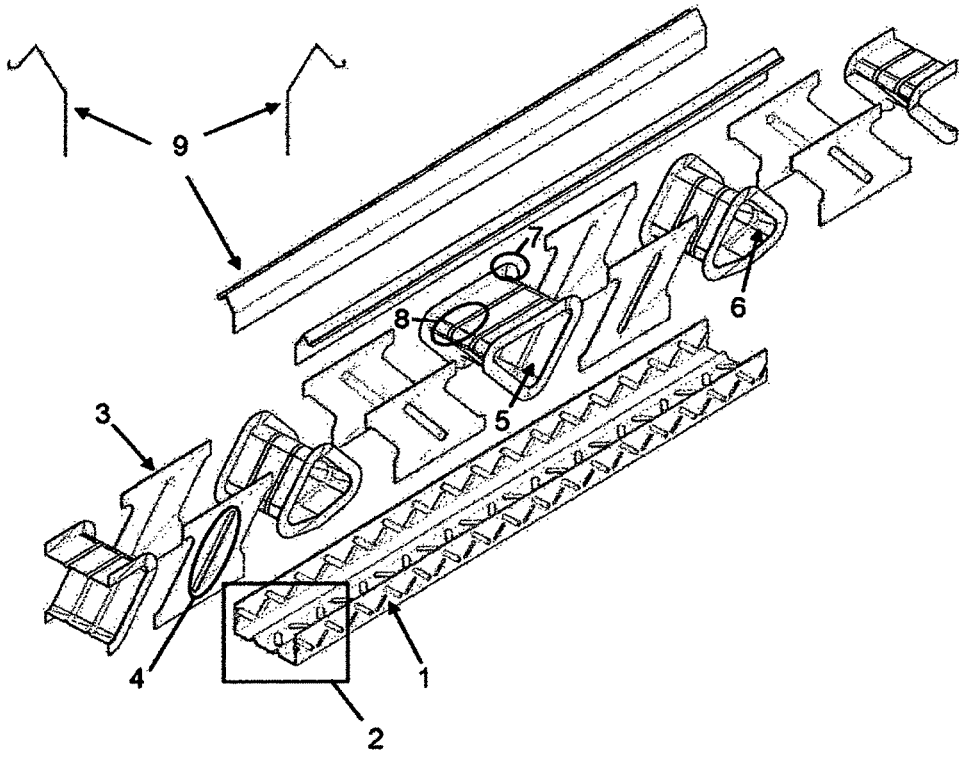
FIG. 1, shows the structural features of the current invention

In the designed ceiling, the concrete load bearing capacity of the joists is used to reduce the steel consumed, and lining the floor will be lighter due to the possibility of pipelines running through the ceiling and inside the cavities in the ceiling.

The joists are designed to cover the roof as composite truss are applicable in various types of buildings such as: residential, commercial, office buildings, etc., which can be extended to prefabricated shear walls.

These joists are shaped using cold rolling steel sheets, and their parts are connected by screws. The specific shape of the joists makes it possible to penetrate concrete inside the joists formed from cold rolled sheets during casting concrete and the composite joists are integrated in combination with the roof slab without the need for a pin to connect the slab to the roof joists.

Removing the bars and the use of cold rolled steel sheets in combination with concrete in a new way eliminates the pins and, without them, concrete and steel sheets are bonded together.

Simplifying its implementation during the construction phase will speed up the implementation of the ceiling and it does not require special, heavy and expensive equipment for implementing. Also, the possibility of passing the facility from below the ceiling will reduce costs on the flooring as well as due to lighter roof and structure and the use of less materials will reduce the environmental pollution.

The important point in the designed joists is how to blend cold-rolled sheets with concrete; as a matter of fact, without the need for pin, concrete of ceiling and joists are integrated together. This is a novelty in addition to the ceiling itself, which has a new design.

The joists designed for the roof, in addition to removing the extra charge, also reduce the consumption of steel. Cold rolled sheets are connected by screws and form the main stringer, which is a truss, the components of which are from formed and cold rolled sheets. The elements used in making the joist are the main elements and have a structural role and do not impose additional load on the structure and do not require permanent molds to execute. This is done with cold rolled steel sheets, which increases the inertia moment and thus the gyration radius, which leads to more resistance with less steel. Most importantly, considering the fact that all stages of the manufacture of trusses are carried out at the factory, it reduces human error very effectively and dramatically due to its design.

The steel bearing capacity of a given shape, which is given to steel plates, is increased. It is not just the thickness of the sheet to increase the load capacity, but the shape of steel sheets increases the inertia moment and the gyration radius, so that less steel can be used to withstand loads more than existing ceilings.

The concrete load bearing capacity is also used to withstand the roof load by roof joists, which is usually less costly than steel.

According to the special shape of the roof joists, which are made of cold-rolled sheets, the casted concrete is completely molded with roof joists and forms a solid structure that does not require pin. The absence of these members will reduce the cost and speed of implementation, and despite the fact that the roof is a composite; it can be easily applied with steel and concrete structures.

It is important to note that the members are designed in such a way that there will be no possibility that the members will be located in a place other than their original location, which would eliminate the human error during the construction phase.

Steel or galvanized sheets can be used in the joist, and the joints will be used to connect the members, which will increase the speed at the construction stage.

The main advantage of this beam is the reduction of environmental pollution. Thus, with a lighter structure and a reduction in consumables, we will see a dramatic reduction in the consumption of fossil fuels and reduced use of natural resources.

It should also be noted that with the special form of the joist, it is possible to pass the pipelines under the ceiling easily and practically, and will reduce the cost of flooring.

The designed joist can be generalized to the shear walls, since designed wall plays the role of the mold and plays its structural role and instead of using the round bar, the steel or galvanized sheets will be used. Reinforcement, molding and unpacking the molds will be eliminated, and in addition to reducing the costs it increases the speed of executing.

LIST OF ELEMENTS

The following is the list of all the structural features and elements displayed in the drawings:

1 A U-shaped beam, which is installed under the joist

2 enlarged view of beam 1 displaying the details

3 The side formed Sheets cut into an "S" shape, which are mounted on the sides (S-shaped and reversed S-shaped (Z-shaped) pieces)

4 Slots created in the S-shaped structure to enhance the strength and ease of installation

5 Triangular-shaped prisms are placed in the middle of the joists and between S-pieces
6 Diamond-shaped prism
7 The edges of the upper and lower base of the prisms is bent 90° facing the outer walls of the prisms
8 At least two ditches circle around the deltas and reversed deltas; allowing easier exit of concrete bubbles.
9 The V-shaped upper shaped sheet (connecting member), which is mounted on the upper side of the joist (hereinafter the upper edge)
10 Slope of the lower part of the diamond prism
11 Screw for the connection of parts to each other
12 Hollow pits/notches of the U-shaped beam
13 Longitudinal indentations/grooves along the bottom length of the U-shaped piece
15 The end piece for beam's support
26 Short four sided scraped woods to be passed through triangular sheets
27 Long four sided scraped woods to be executed on parts 26
28 Mold plates
29 Reinforcement
30 Knee for execution of mesh network cover
31 Mesh network covering
32 Roof concrete

DETAILED DESCRIPTION OF SPECIFICATION

As shown in the figures, in the present invention, the beam consists of a plurality of pieces, each piece being fastened to other parts, which creates a robust consolidated product. The best mode of the invention is described as the following:

1: U-shaped steel is formed from cold-rolled steel sheet (galvanized or steel sheets; cut first hand in the form of stripes by the rolling device and are next formed by roll forming devices), in the form of a "U" shape. The U-shaped piece is placed under the joists, and the lower edge (Bottom Chord) forms a truss.

Figure 2:
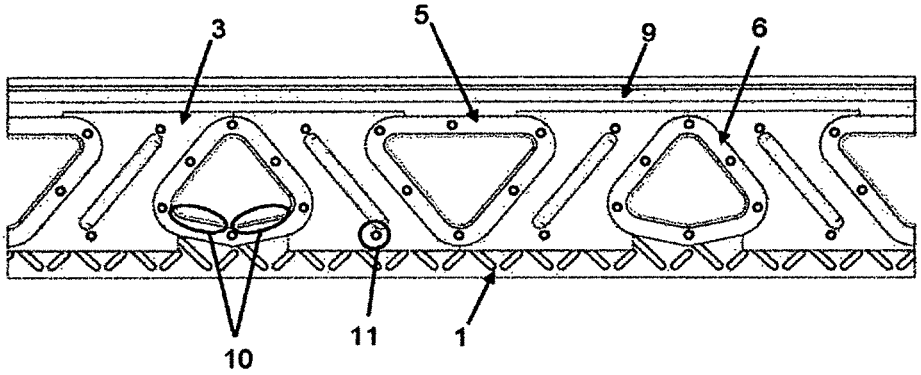
FIG. 2, is an enlargement of U-shaped piece 1
Figure 3:
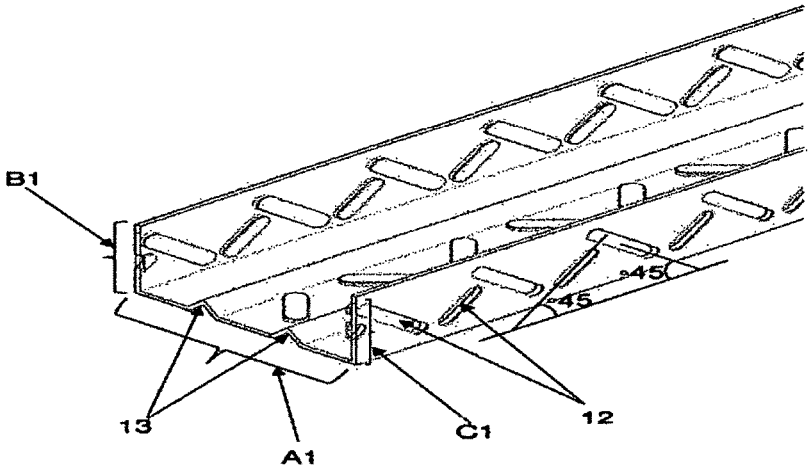
FIG. 3, displays different connection of the roof
Figure 4:
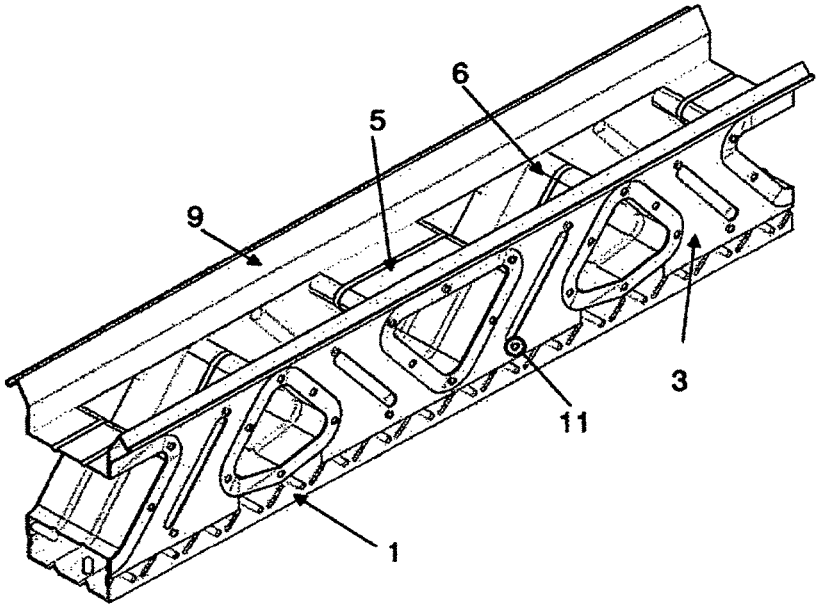
FIG. 4, displays different connection of the roof
Figure 5:
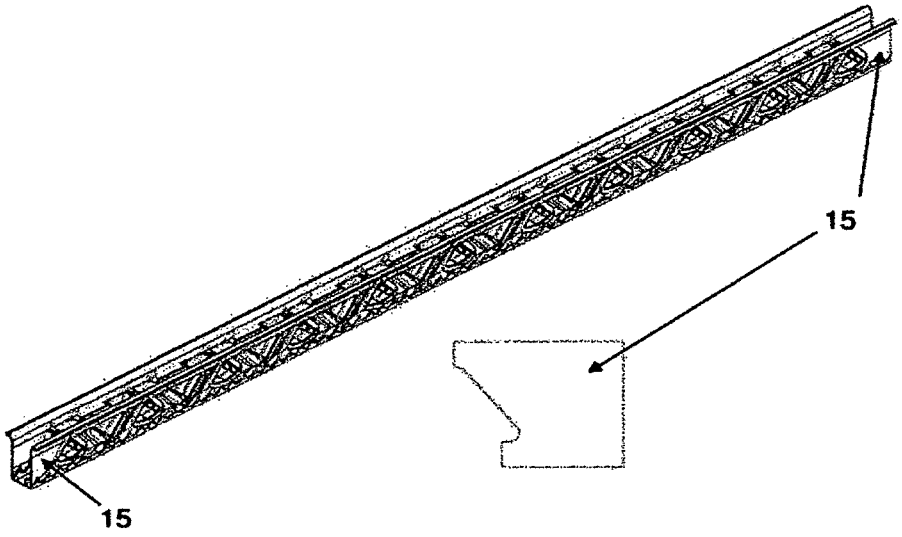
FIG. 5, displays different connection of the roof
Figure 6:
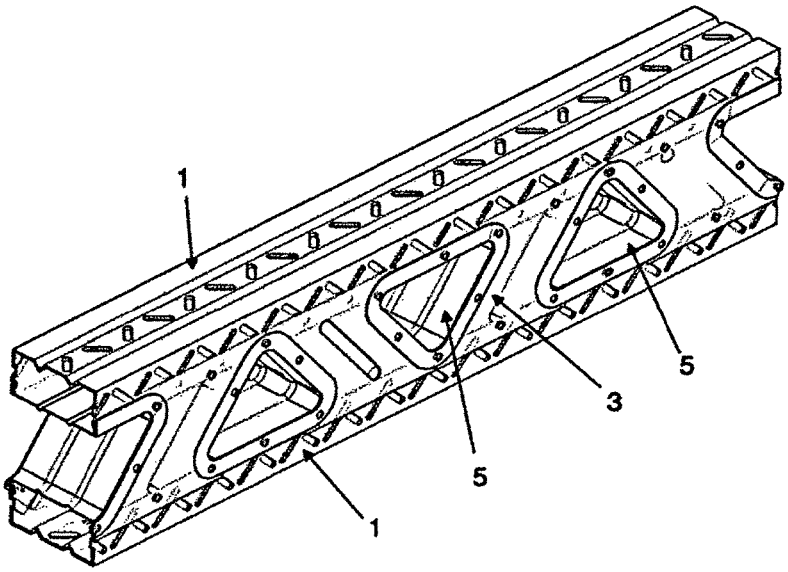
FIG. 6, another embodiment of the invention

2: The enlargement in FIG. 2, the U-shaped beam has three parts. Two longitudinal groves (13) along the length of the U-shaped beam (as displayed in the 1A section), has a triangular shaped indentation facing upwards towards the inner area of the U-shaped beam. The arms of the beam (as displayed in areas 1B and 1C) make a 90 degree angle with respect to the midsection of the beam where the longitudinal grooves are located at. Wherein these arms comprise hollow pits. The grooves in conjunction with the hollow notches (12); not only enhance the rigidity but also allows the joist to be entangled with the concrete in order to create a solid structure where the concrete falls and sits in the grooves and pits.

As described previously the U-shaped beam is made of galvanized and steel sheets cut by a rolling device and then formed into a U-shaped structure. The notches (12) are placed on each one of the beam arms in a zig zag pattern. Wherein each adjacent zig-zags with respect to the midsection of the beam edge form a 45-degree angle along the beam.

The notches along the arms of the joist/beam are indented/concaved towards the inner space between the U-shaped beam (inward inclination). They enhance the adherence and engagement between the steel sheets and the concrete.

Different parts and structural elements of this invention when interlocked with each other form a solid foundation which will be described below.

Two beams interlock with one another using S-shaped and reversed S-shaped (3) structures, creating a joist. Wherein each one of the S-shaped structures has a notch; along the diagonal length of the S-shaped or reversed S-shaped pieces. The S-shaped and its reversed structures are also created utilizing the cold-rolling technique similar to that of the U-shaped beams.

The S-shaped notch (the notch of the S-shaped structure) is concaved towards the inside of the joist (when fully assembled). The S-shaped pieces are placed on the outer surface of the arms of the beam. Wherein two parallel S-shaped pieces are placed along the outer surface of the arms and two parallel reversed S-shaped (Z-shaped hereinafter) when placed in adjacent and on either side of each of the arms create Delta-shaped and reversed delta-shaped gaps (where prism 5 and 6 are located at) respectively. The S-shaped and Z-shaped structures are attached to the outer surface of the arms of the beams via screws/bolts.

The delta and reversed gaps created as explained above is filled with their respective triangular-shaped prism (5)/diamond-shaped prism (6) structures. Wherein the triangular prismed-shaped structure, has a hollow body along the length of the prism, and has an upper and lower base on either side. The upper and lower bases have a surface extending from the edge of the hollow interior body, and passing beyond an outer surface of the prism; keeping a triangular-shaped surface. The hollow interior also has a triangular-prism shape. The area of the upper and lower base (7) is larger than the cross-section of the main body of the triangular prism. The three edges of the upper and lower triangular bases of the triangular prism, are parallel to that of the triangular prism.

The triangular shaped prism will fill the delta-shaped gap between two S-shaped and Z-shaped structures. The triangular upper and lower base of the triangular-shaped prism sit on top and of and over the two arms from one edge (hereinafter bottom edge) and the diagonal edge of each of the S-shaped and Z-shaped structures will connect and placed inside the inner surface of the other two edges of the triangular upper and lower bases respectively.

The triangular-shaped prism has two indentations going in parallel as a line (8) with respect to one another and around the main body of the prism. The outer edges of the upper and lower base are bolted on the S and Z shaped structures and are held tightly in place.

The external parallel indented lines around the outer surface of the triangular-shaped prism sheds the concrete air inside the joist.

The reversed delta-shaped gaps between the S and Z-shaped sheets is filled with a diamond shaped prism. This prism is similar to the triangular-shaped prism, except that its bottom has an upward slope in order to allow the concrete to penetrate into its bottom. In another embodiment of the invention the diamond-shaped prism is replaced with a triangular-shaped prism.

In another embodiment both prisms can have a circular cross-section and have a cylindrical shape. However it is better to keep the triangular and/or diamond shaped structure since it creates a higher degree of rigidity. Also when these parts are made in the form of triangle, galvanized/steel sheets wastes will be less when producing the S-shaped sheet.

In order to create the joist the triangular and diamond shaped upper and lower bases are bolted and screwed on top of the S and Z-shaped sheets. The U-shaped piece is placed underneath the bottom edges of the prisms and bolted/welded in place. Another beam is placed on top of the united structure and held in place via two connecting members (9). The connecting members are two separate V shaped structures, wherein one end of the V is bent slightly, extending upwards and sits on top of the two prisms touching an inner surface of the upper and lower bases of each of the prisms. The V shaped structure is bent on the other end of the V arm, forming a reversed small v that receives and holds the arms of the U-shaped beam placed on top of it, wherein this second beam is parallel and facing inwards towards and inner area of the final joist.

In another embodiment the second U-shaped beam can be used without connecting members (9). This piece is also made of galvanized steel sheet, cut into stripes and shaped by roll forming machines.

The cavities created within the two prisms are used for temporary molding for casting concrete and installation of the facility under the ceiling. In the construction process, the upper connecting member (9) is the last piece that is connected to the other pieces. At least two end pieces (15) are placed at either end of each beam, holding the rest of the structure in place.

Figure 7:
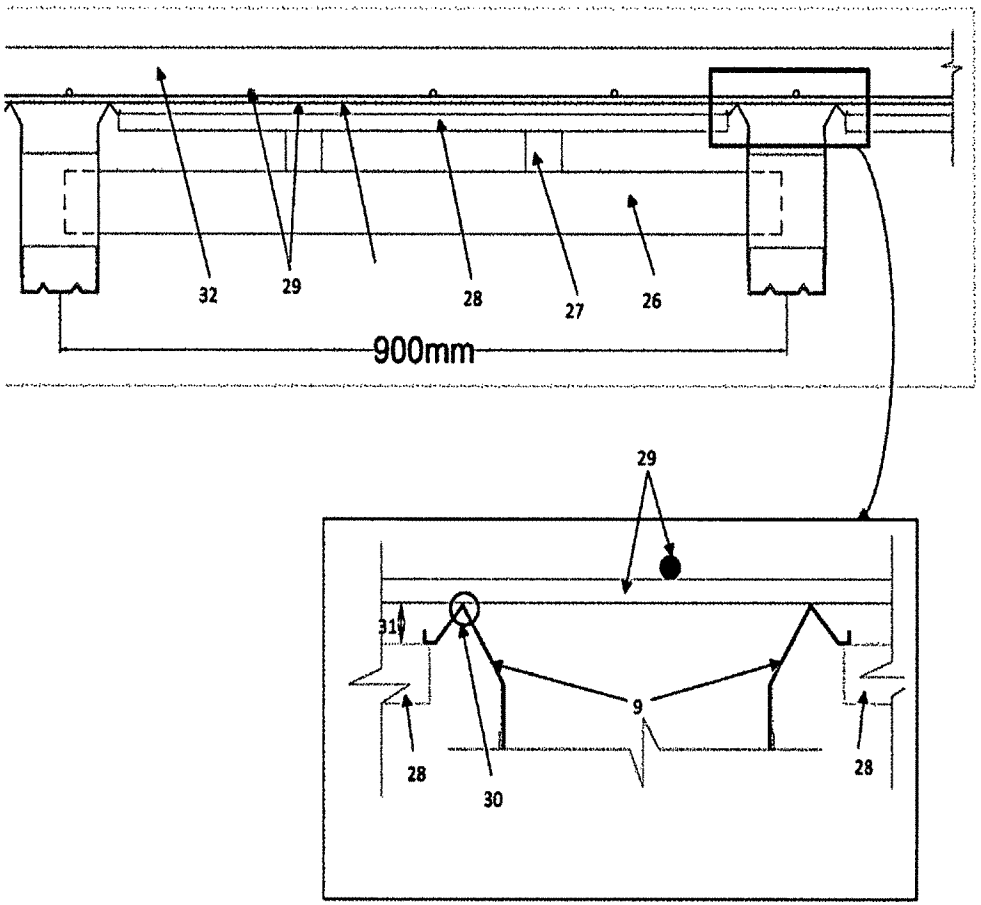
FIG. 7, displays connection of joists

FIG. 7 displays the method via which the joists are installed in the roof structure. First of all, the produced joists are placed over the load bearing beams of the structure at a certain gap from one another.

When the joists are installed at their own place, the roof formwork begins. For this purpose, the holes that exist in triangular shaped prism 5 and diamond shaped prism 6 can be used to allow scarp woods 26 pass through them like what is displayed in FIG. 7. At first, a long four sided scrap wood (27) and mold plates (28) are connected to one another and beneath the roof, joists are put immediately beside V-shaped structure. Next, scrap woods 26 pass through triangular holes of triangular and diamond prism 5 and 6 to fix long four sided scraped wood; 27 and 28 at their place.

29—The roof reinforcement is executed after the formworks, being supported by the top of the V-shaped piece 9, as displayed in details in the FIG. 7.

32: The roof concrete. After reinforcement (29), the concrete works of the roof begins. After execution of concrete and when the concrete is hardened, the molds are opened. To open the molds, first of all, short four sided scraped woods 26 are removed from the holes. This allows long four sided 27 and mold plates 28 to be released and ultimately the mold is separated from the roof.

The invention claimed is:

1. A truss joist composite ceiling comprising:

At least one U shaped cold formed steel having two longitudinal grooves/indentations pointing upwards and towards an inner area of said U-shaped beam; the U-shaped beam further comprising two arms located at a 90 degree angle with a midsection of said beam; wherein each arm comprises hollow pits/grooves;

multiple triangular shaped and diamond shaped prisms;

multiple S-shaped and reversed S-shaped (hereinafter Z shaped) steel sheets;

wherein said S-shaped structure comprises multiple notches on its surface; wherein said notches are concaved towards an inner surface of said joist; wherein said triangular shaped prisms and said diamond shaped prisms have a hollow body along their respective lengths and wherein each of said prisms further comprises an upper and lower base; wherein said upper and lower bases of each one of said triangular and diamond prisms have their respective surfaces extending from an edge of said hollow body of said prisms, and passes beyond an outer surface of said triangular shaped and diamond shaped prism; wherein two parallel S-shaped structures are placed along and on either side of an outer surface of each of said arms of said U-shaped beam; two parallel Z-shaped structures is placed in adjacent to said S-shaped sheet and on either side of each of said arms; wherein a Delta-shaped and reversed delta-shaped gap is created between said adjacent S-shaped and Z-shaped sheets accordingly; wherein said S-shaped and Z-shaped sheets are attached to said outer surface of said arms of said beams via screws/bolts; wherein said triangular shaped prism and diamond shaped prism fill in the delta-shaped and reversed delta-shaped gaps in matching angles creating a solid and unified structure;

and wherein each of said adjacent/neighboring S-shaped and z-shaped sheets attached and matched to said angle of each one of said triangular and diamond shaped prisms are mirror image of one another; wherein said S and Z shaped sheets are bolted/welded to said extended outer surface of said upper and lower base of each of said triangular and diamond shaped prisms; and wherein said U-shaped beam is placed and locked/screwed underneath a bottom edge of each of said multiple triangular and diamond-shaped prisms; wherein a second U-shaped beam on top of said multiple triangular and diamond shaped prisms.

2. The truss structure of claim 1, wherein each one of said triangular and diamond shaped prisms comprise two parallel indentations going around an outer surface of their respective prisms.

3. The truss structure of claim 2, wherein said longitudinal indentations on said U-shaped sheet are triangular projections on a bottom surface of said beam and extending along a length of said beam.

4. The truss structure of claim 3, wherein two V-shaped fixation/connecting members are located between said second U-shaped sheet and said multiple triangular and diamond shaped prisms and said multiple S-shaped sheets; wherein said V-shaped connecting member comprise two bended edges on either side of arms of said V-shaped connecting members; wherein one of said arms of said V-shaped member has a bend on one end creating a small reversed v shape that securely holds said arms of said second beam in place and on top of said multiple triangular and diamond shaped prisms that are connected to said S-shaped and Z-shaped sheet; and a slight bend on another arm of said V-shaped connecting member that has a longer edge that fits tightly next to said extended edge of said upper and lower surfaces of said multiple triangular and diamond prisms.

5. The truss structure of claim 4, wherein said second U-shaped sheet covers said two fixation V-shaped pieces facing towards said inner area of said joist and is parallel to said other U-shaped sheet.

6. The truss structure of claim 5, wherein a ceiling comprises multiple beams, each passing through said hollow prisms creating a meshed structure of said ceiling.

7. The truss structure of claim 6, wherein said meshed structure is covered with mold plates on top and bottom, and filled with reinforcement material.

8. The truss structure of claim 7, wherein said reinforcement material is further covered with roof concrete.

9. The truss structure of claim 1, wherein said arms of the U-shaped structure further comprises multiple notch/pits are spread out and on an outside surface of said arms; wherein each of said adjacent notches form a zig-zag patterns with respect to said midsection of said beam.

10. The truss structure of claim 9, wherein said multiple notches form a 45-degree angle with respect to a lower edge of said U-shaped structure; and wherein said notches are placed along a length of said arms and are concaved towards said inner area of said U-shaped structure.

11. The truss structure of claim 10, wherein said hollow interior area of both prisms has a shape similar to that of their respective prisms; and wherein said upper and lower base of each of said prisms are larger than a cross-section of a main body of said triangular and diamond prisms.

12. The truss structure of claim 11, wherein said S-shaped structures are placed on an outer surface of said arms of said beam and wherein each one of said triangular and diamond prisms comprise.

* * * * *